United States Patent [19]

Schuler

[11] 4,333,187

[45] Jun. 8, 1982

[54] SHOWER CURTAIN

[76] Inventor: Bob A. Schuler, 2426 Wood Oak Ct., Irving, Tex. 75060

[21] Appl. No.: 198,914

[22] Filed: Oct. 20, 1980

[51] Int. Cl.[3] ..... A47K 3/22

[52] U.S. Cl. ..... 4/608; 4/610; 160/330

[58] Field of Search ..... 4/596, 597, 605–610, 4/552; 160/330, 390, 349 R, 349 D

[56] References Cited

U.S. PATENT DOCUMENTS

| | | | |
|---|---|---|---|
| 1,507,670 | 9/1924 | Eisele | 4/607 X |
| 1,791,696 | 2/1931 | Alexander | 4/609 |
| 2,212,326 | 8/1940 | Piken | 4/608 X |
| 2,668,298 | 2/1954 | Kimmons | 4/608 |
| 3,035,275 | 5/1962 | Strebeigh | 4/608 |
| 3,321,003 | 5/1967 | Boerner | 160/330 |
| 3,808,610 | 5/1974 | Mortensen | 160/349 D X |
| 3,864,760 | 2/1975 | Bowen | 4/597 |
| 3,995,330 | 12/1976 | Meyers | 4/605 |
| 4,077,072 | 3/1978 | Dezura | 4/608 X |
| 4,098,318 | 7/1978 | Ruegsegger | 160/349 D X |

FOREIGN PATENT DOCUMENTS

| | | | |
|---|---|---|---|
| 960956 | 1/1975 | Canada | 160/349 R |

*Primary Examiner*—Stuart S. Levy

*Attorney, Agent, or Firm*—H. Mathews Garland

[57] ABSTRACT

An integrated plastic shower curtain assembly including a pair of rectangular curtain panels secured together in overlapping relationship along inside vertical edge portions by a securing strip folded over and heat sealed with horizontal top edge portions of the curtain panels. A horizontal plastic net panel is secured along a bottom edge portion with the curtain panels by the securing strip. The vertical outside side edges of the curtain panels are each provided with a securing strip of Velcro and is connected along each outside vertical side edge of the curtain panels and a similar strip is provided for connection with an adjacent vertical wall surface for securing the outside vertical edges of the panels with walls at opposite sides or ends of a shower enclosure. Each of the curtain panels has a tie back along each vertical outside edge for gathering and holding the curtains apart for entry and exit into and out of the shower enclosure. Spaced shower hooks are used to support the curtain assembly from a horizontal rod. At the opposite ends of the assembly, a bracket is used having a supporting rod for holding the net panel at an upwardly and inwardly extending angle with the ceiling over the shower enclosure to minimize movement of moisture from the shower enclosure outwardly into the surrounding room.

7 Claims, 7 Drawing Figures

SHOWER CURTAIN

This invention relates to a shower curtain and more particularly relates to a more fully integrated shower curtain assembly.

Shower curtains are currently available in a variety of forms. The most simple shower curtains are plain, single panels of water resistant or waterproof material which hang on hooks supported on a horizontal bar above a tub or shower enclosure. Other shower curtains come in pairs of panels which are similarly supported and may be pushed aside for entry and exit. A variety of arrangements are available for securing the outside vertical edges of shower curtains with wall surfaces to minimize splashing of water from the shower enclosure. Most shower curtain arrangements hang substantially below the ceiling level so that there is a large open space over the shower curtain resulting in the movement of air and moisture between the shower enclosure and the room in which the shower is located. This not only cools the bather but also deposits substantial moisture into the surrounding room which tends to condense on the walls, mirrors, and other surfaces which may be damaged by the moisture. One structure which addresses this problem is a solid plastic sheet which permits no air movement and thus confines all of the air and moisture strictly within the shower enclosure which does prevent the escape of the moisture into the room, but also creates an undesirable ventilation condition within the shower enclosure itself around the bather. Another problem encountered with most existing shower curtain arrangements is the tendency of the inside vertical adjacent curtain edges to separate allowing splashing of water from the shower enclosure into the room. This has been solved in the past by a zippered vertical connection between the adjacent panels in one instance and by a somewhat complicated hanger-bracket arrangement overlapping the panels in another instance. Both of these solutions are somewhat more complicated and expensive than is necessary to solve the problem.

It is a particularly important object of the present invention to provide a new and improved shower curtain assembly.

It is another object of the invention to provide a fully integrated shower curtain assembly.

It is a further object of the invention to provide a shower curtain assembly having means for securing the vertical outside edges of the shower curtains with adjacent wall surfaces.

It is another object of the invention to provide a shower curtain assembly which overlaps the inside vertical edges of the panels minimizing the splashing of water outside of the shower enclosure.

It is a further object of the invention to provide a shower curtain assembly which minimizes moisture flow between the shower enclosure and the room above the curtain while permitting ventilation.

In accordance with the invention, there is provided an integrated shower curtain assembly including two rectangular panels of sheet material arranged in overlapping relationship along the vertical inside edges of the panels, a horizontal securing band extending across and sealed with the top edges of both the panels, holes provided in spaced relation along the top portion through the securing strip and top edges of the panels for shower curtain hooks, a plurality of hooks in such holes for supporting the assembly from a horizontal rod, a securing strip along the outside vertical edge of each of the panels for releasable connection with an adjacent wall surface, a tie-back band secured with each vertical outside edge of each of the panels for tying each of the panels back adjacent to the vertical wall surface when the curtain assembly is not in use, and a horizontal panel of porous netting extending across the full width of both of the panels and having a horizontal edge sealed with the panels in the horizontal securing strip and supported upwardly and inwardly of the panels on end brackets which support opposite ends of the panels from the horizontal rod and support the ends of the netting between the upper horizontal edge of the panels and the ceiling surface over the shower enclosure inwardly of the panels.

A preferred embodiment of a shower curtain assembly in accordance with the invention and the foregoing objects and advantages will be better understood from the following detailed description of the shower curtain assembly taken in conjunction with the accompanying drawings wherein.

Figure 1:
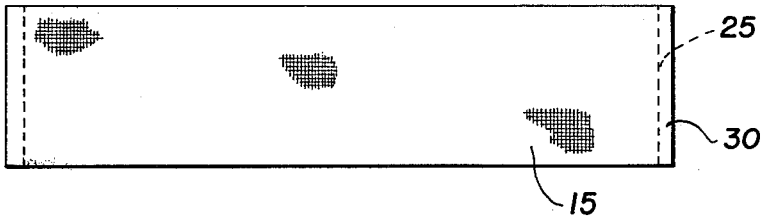
FIG. 1 is an elevational view of the horizontal netting panel of the shower curtain assembly.
Figure 2:
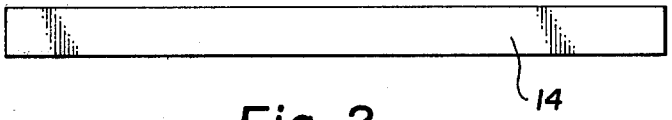
FIG. 2 is an elevational view of the horizontal securing strip used to connect the curtain assembly components together.
Figure 3:
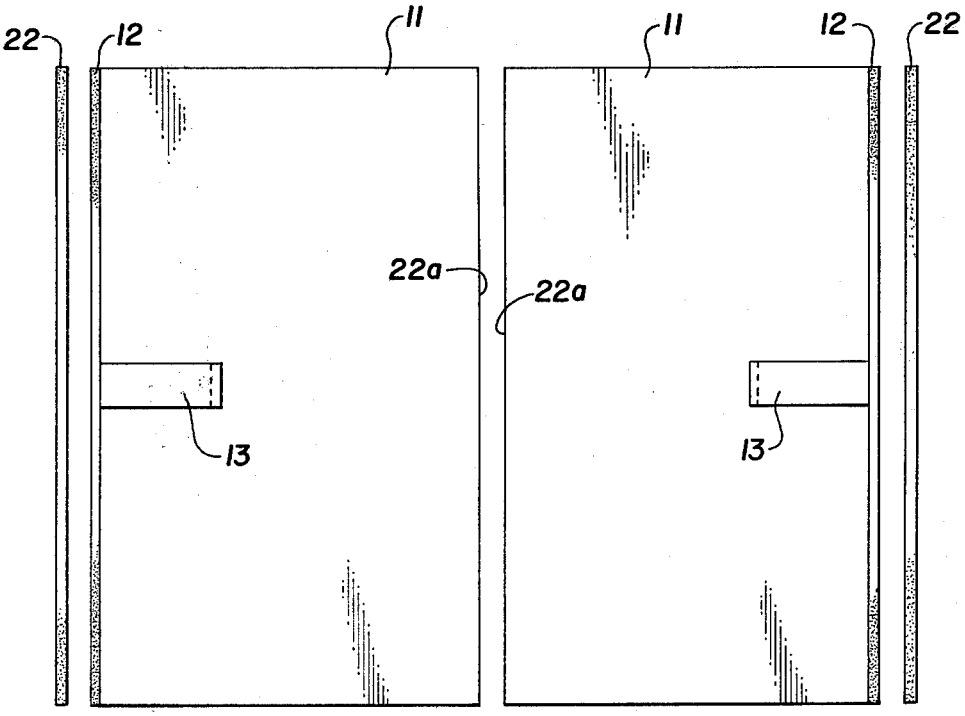
FIG. 3 is an elevational view of the main shower curtain panels of the assembly showing the tie-back bands and vertical securing strips.

Referring to the drawings, a shower curtain assembly 10 embodying the features of the invention includes a pair of main panels 11 each having a vertical securing strip 12 along the vertical outside edge thereof and horizontal tie-back strips 13, a horizontal securing strip 14, a netting panel 15, shower curtain hooks 20, netting support brackets 21, and vertical securing strips 22 for connecting the vertical outside edges of the panels to wall surfaces. The main panels 11 and the netting panel are secured together by the horizontal strip 14 forming an integral shower curtain assembly.

The panels 11 and the securing strip 14 are solid plastic sheets which are waterproof. The securing strips 12 are preferably made of a securing material sold under the trademark Velcro which comprises a large number of hooks formed on a plain surface which may be releasably interconnected with a similar strip having hooks by pressing the two strips together and are readily disengaged by pulling the strips apart. Velcro is a well known, commercially available product for securing sheet materials together. The tie-back strips 13 are made of the same material as the panels 11. Similarly, the securing strip 14 is made of the same material as the panels 11 while the panel 15 is preferably a porous plastic netting which is inert to water while having a large number of openings allowing the passage of air through the panel. The securing strips 22 are also made of Velcro along one surface and have an adhesive-like opposite surface for securing the strips with a wall surface. The hooks 20 and brackets 21 are conveniently made of either metal or plastic.

Figure 4:
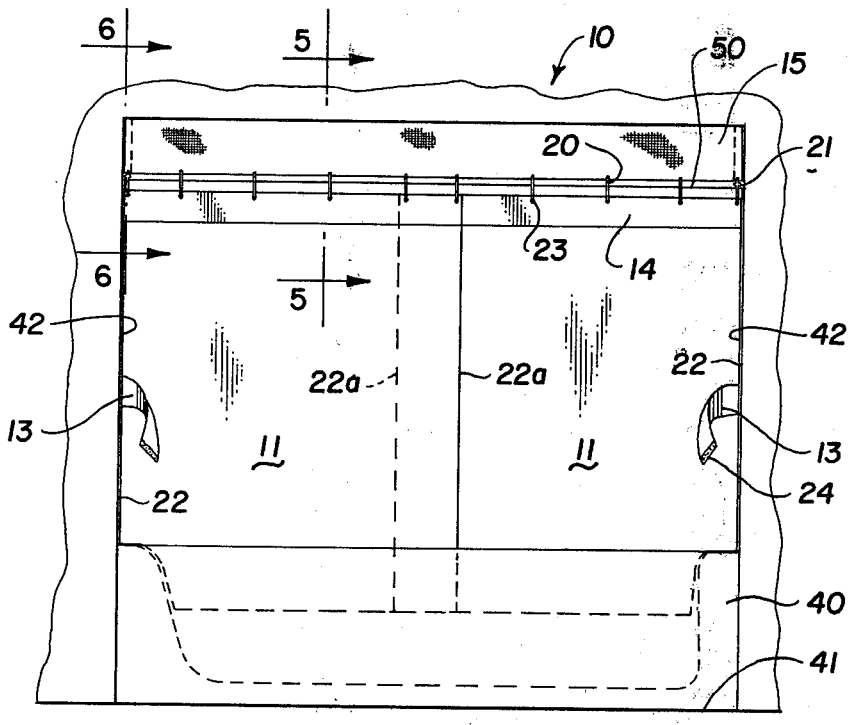
FIG. 4 is an elevational view of the complete shower curtain assembly in a shower enclosure having a tub.
Figure 5:
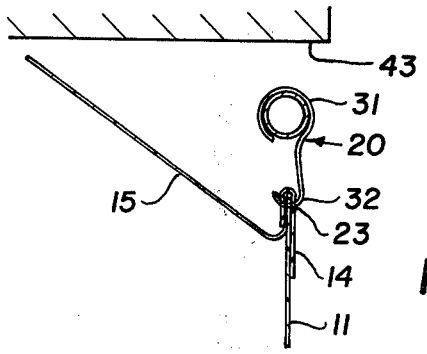
FIG. 5 is a vertical view in section along the line 5—5 of FIG. 4 illustrating one of the hooks employed to hang the shower curtain assembly from the horizontal rod.
Figure 6:
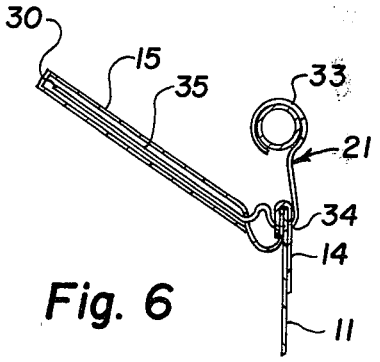
FIG. 6 is a vertical sectional view along the line 6—6 of FIG. 4 showing one of the end brackets used to support the netting panel at an angular position within the shower enclosure.

Referring to FIGS. 4–6, the panels 11, the securing strip 14, and the net panel 15 are connected together to form an integral assembly by the strip 14 which is heat sealed with the panels 11 and the net panel 15. The panels 11 are placed in the relationship represented in FIG. 4 with the inside vertical edges 22*a* overlapping several inches as apparent in FIG. 4 and the securing strip 14 extending across the top portions of the panels and the bottom portion of the net panel 15. As best represented in FIG. 5, a lower horizontal edge portion of the panel 15 is placed across the inside surface of the top edge portions of the panels 11 with the securing strip 14 similarly placed across the top horizontal edge portions of the panels 11 folded around the top edges of the panels downwardly along the inside face of the upwardly folded lower edge portion of the net panel 15 and the strip 14, the panels 11, and the panel 15 are heat sealed together all the way across the full lengths of the strip 14, the panel 15, and the widths of the top edge portions of the panels 11. Thus, the top edge portion of the assembly is then made up of a double layer of the folded over strip 14, a single thickness of the lower edge of the net panel 15, and a single thickness of the top edge of the panels 11 except along the overlapping portions of the panels 11 along the inside edges of the panels as shown in FIG. 4. The layered edge portions of the panels 11 and 15 along with the strip 14 is provided with a plurality of spaced holes 23 along the full width of the assembly as evident in FIG. 4 for the hooks 20 and net support brackets 21.

The Velcro strips 12 and the tie-backs 13 are suitably secured to the panels 11 by any satisfactory means depending upon the materials such as sewing or heat sealing. The Velcro members 12 are secured along the front faces of the vertical outside edges of the panels 11 so that the Velcro surfaces are folded backwardly for securing with adjacent wall surfaces to minimize water splashing into the securing surface of the Velcro. The tie-backs 13 each have Velcro strips 24 along the free end edges so that they may fold around the panels and be placed against the Velcro surfaces of the strips 22 along the wall at each end of the curtain assembly to temporarily tie the panels back when the curtain is not in use. The opposite vertical end portions of the net panel 15 are folded over and heat sealed along a line 25 to form an opening 30 along each end portion of the panel to receive the support brackets 21 which hold the net panel in the angular position upwardly toward the ceiling as seen in FIGS. 5 and 6.

Figure 7:
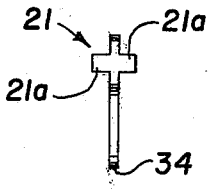
FIG. 7 is a side view in elevation of one of the netting support brackets.

Each of the hooks 20 has a large semi-circular downwardly opening hook portion 31 for fitting over the support rod and a lower upwardly opening hook portion 32 for fitting through the shower curtain assembly holes 23 to connect the hooks with and support the shower curtain assembly. Each of the net brackets 21 has an upper downwardly facing semi-circular hook portion 33 for engagement over the support rod, a lower upwardly opening hook portion 34 which fits through one of the shower curtain assembly openings 23 at the opposite ends of the assembly, and upwardly extending support rod portion 35 which engages the end openings 30 along the opposite ends of the net panel 15 so that the rods 21 support the net panel at the desired angular position. As shown in FIG. 7, each bracket 21 has lateral tabs 21*a* to minimize a tendency of the netting to twist each of the brackets on the horizontal rod 50 supporting the curtain assembly.

FIG. 4 illustrates a typical shower enclosure in which the curtain assembly of the invention may be used. Referring to FIG. 4, a tub 40 is supported on a floor 41 in between opposite end walls 42 beneath a ceiling 43. The curtain assembly is quickly and easily installed in the shower enclosure over the tub. First, the Velcro strips 22 are each secured to the end wall surfaces 42 by the adhesive-back faces of the strips 22. Each of the strips 22 is placed along a vertical line along the wall surface above the outside edge of the tub. The hooks 20 are then installed in all of the holes 23 along the top edge of the curtain assembly except the opposite end holes. In each of the opposite end holes 23 one of the brackets 21 is installed with the support rod portion 35 of each of the brackets inserted into the end opening 30 of the net panel 15. The top edge of the curtain assembly is then lifted and the upper hook portions 31 of the hooks 20 and the hook portions 33 of the brackets 21 are lifted over and hooked on the horizontal rod 50 extending between the end walls 42 over the outer edge of the tub thereby supporting the curtain assembly over the tub. The full length of the assembly is held from the rod 50 by the hooks 20 while the ends of the assembly are supported from the rod by the brackets 21 and the net panel 15 is supported at the angular position extending upwardly and backwardly toward the ceiling 43 by means of the brackets 21. The Velcro surfaces of the securing strips 12 are pressed against the Velcro surfaces of the strips 22 along the end walls, thereby securing the outside end vertical edges of the panels 11 with the end wall. If the shower curtain assembly is to be used immediately the tie-backs 13 are left hanging free as shown in FIG. 4 while the curtain panels 11 hang freely downwardly into the tub 40 as shown in the FIG. 4. The length of the panels is sufficient that lower portions of the panels hang into the tub to prevent water splashing outwardly from the tub. If the curtain assembly is not to be used immediately, each of the panels may be gathered along the middle portions and the tie-backs 13 folded backwardly around the gathered portions of the panel with the Velcro end edges 24 of the tie-backs inserted between the Velcro surfaces of the strips 12 and 22, thereby holding the two curtain panels apart for easy entry and exit into and from the shower enclosure.

When a shower is to be taken, the shower enclosure is entered and the two tie-backs 13 are released by disengaging the Velcro end tabs 24 from between the Velcro surfaces of the strips 12 and 22 allowing the two curtain panels 11 to drop freely to the overlapping relationship illustrated in FIG. 4. The lower end portions of the panels 11 drop into the tub lying closely along the inside surface of the tub from the secured opposite ends at the Velcro strips securing the ends along the lower edges of the panels to the overlapping vertical inside edge portions of the panels. Thus, as water is run from a shower head the water is all deflected downwardly into the tub preventing a splashing out of the tub into the surrounding room. The porous net panel 15 across the top portion of the shower curtain assembly extending upwardly at an angle with the ceiling 43 over the shower enclosure permits air circulation between the room and the shower enclosure while preventing splashing water over the panels 11 into the room and minimizing the movement of moisture into the surrounding room. Obviously, some moisture will carry over into the room, but the quantity will not be as great as would occur if the net panel 15 were not in place.

Thus, it will be seen that a new and improved shower curtain assembly has been described and illustrated. The shower curtain assembly is primarily an integral unit supported by a set of shower curtain hooks and brackets for holding the porous net panel in place. The curtain assembly fits closely along end walls of the shower enclosure, hangs into the tub, and overlaps to substantially eliminate a splashing of water from the enclosure into the surrounding room.

What is claimed is:

1. A shower curtain assembly for use across an opening into a shower enclosure between vertical walls adjacent to said enclosure and ceiling, said assembly comprising: two shower curtain panels positioned in adjacent coplanar overlapping relationship along vertical inside edge portions; securing means along vertical opposite end outside edge portions of said panels for securing each of said panels along said outside edge portion with an adjacent vertical wall surface; a horizontal securing strip secured and folded in overlapping relationship with the horizontal top edge portion of said curtain panels; a horizontal net panel secured along a bottom edge portion with said top edge portions of said curtain panels and said securing strip; and hanging and support means for supporting said curtain panels and said net panel from a horizontal rod across said opening into said shower enclosure and for supporting said net panel at an upward and inward angle from said curtain panels toward said ceiling.

2. A shower curtain assembly where said curtain panels, said securing strip, and said net panel are secured together along said top edge portion of said curtain panels and said lower edge portion of said net panel to form an integral shower curtain assembly.

3. A shower curtain assembly in accordance with claim 2 wherein said curtain panels, said securing strip, and said net panel are formed of plastic and heat sealed together to form said integral assembly.

4. A shower curtain assembly in accordance with claim 3 wherein said securing strip overlaps the top edges of said curtain panels and the bottom edge of said net panel.

5. A shower curtain assembly in accordance with claim 4 wherein said securing means along said vertical outside edge portion of said curtain panels comprise a first strip secured along each of said vertical outside edges of each of said curtain panels and a second strip for securing along each side wall adjacent to said vertical end edges of said curtain panel, said first and second strips being each formed of a material having surface features which releasably interconnect said strips when said strips are pressed together and disengage said strips when said strips are pulled apart.

6. A shower curtain assembly in accordance with claim 5 including hooks secured in spaced relation along said top edge portion of said curtain panels through overlapped layers of said securing strip, said curtain panels, and said net panel and end support brackets secured through said layered edge portions of said curtain panels, said securing strip, and said net panel for supporting said curtain panels from a horizontal rod across said opening into said shower enclosure and for suspending said net panel at an upwardly and inwardly extending angle from said curtain panels toward said ceiling.

7. A shower curtain assembly in accordance with claim 6 including a tie-back strip along a central portion of each of said vertical outside edges of each of said curtain panels, each of said tie-back strips being provided with securing means for securing a free end of each of said tie-back strips with the adjacent wall surface for tying each of said curtain panels in a gathered relationship adjacent to each of said wall surfaces to hold said curtain panels open for entry and exit into and out of said shower enclosure.

* * * * *